US011609517B1

(12) United States Patent
Sone

(10) Patent No.: US 11,609,517 B1
(45) Date of Patent: Mar. 21, 2023

(54) FIXING DEVICE

(71) Applicant: TOSHIBA TEC KABUSHIKI KAISHA, Tokyo (JP)

(72) Inventor: Toshihiro Sone, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/686,467

(22) Filed: Mar. 4, 2022

(51) Int. Cl.
*G03G 15/20* (2006.01)

(52) U.S. Cl.
CPC ..... *G03G 15/2017* (2013.01); *G03G 15/2039* (2013.01); *G03G 15/2042* (2013.01); *G03G 15/2046* (2013.01); *G03G 15/2053* (2013.01); *G03G 15/2057* (2013.01); *G03G 2215/20* (2013.01); *G03G 2215/2003* (2013.01)

(58) Field of Classification Search
CPC ..... G03G 15/2017; G03G 15/2039; G03G 15/2042; G03G 15/2046; G03G 15/2053; G03G 15/2057; G03G 2215/20; G03G 2215/2003
See application file for complete search history.

(56) References Cited

U.S. PATENT DOCUMENTS

| | | | | |
|---|---|---|---|---|
| 2016/0154350 | A1* | 6/2016 | Saito | G03G 15/2057 399/329 |
| 2017/0176907 | A1* | 6/2017 | Sawada | G03G 15/2028 |
| 2018/0181037 | A1 | 6/2018 | Kataoka et al. | |
| 2020/0033774 | A1 | 1/2020 | Shinji et al. | |
| 2020/0285180 | A1 | 9/2020 | Matsuda et al. | |
| 2020/0387094 | A1* | 12/2020 | Yamaguchi | G03G 15/2025 |

FOREIGN PATENT DOCUMENTS

| | | |
|---|---|---|
| JP | 2019-219674 | 12/2019 |
| JP | 2021-085930 | 6/2021 |

* cited by examiner

*Primary Examiner* — Joseph S Wong
(74) *Attorney, Agent, or Firm* — Amin, Turocy & Watson, LLP

(57) ABSTRACT

A fixing device includes a tubular body in a tubular shape that forms a nip with a pressurizing member. The heater, disposed inside the tubular body, faces a part of the tubular body in a circumferential direction. The heat equalizing member is disposed on an opposite side of a side where the heater faces the tubular body. The heat equalizing member transfers heat from a place having a high temperature to a place having a low temperature in a second direction along an axial direction of the tubular body. The heat conductive member, disposed between the heater and the heat equalizing member, can conduct the heat in each of the second direction and a first direction in which the heater and the heat equalizing member face each other. A side portion of the heat conductive member in the second direction is divided into three or more portions.

20 Claims, 7 Drawing Sheets

FIXING DEVICE

FIELD

Embodiments described herein relate generally to a fixing device, an image forming apparatus, and methods related thereto.

BACKGROUND

A fixing device includes a tubular body, a heater, and a heat conductive member. The tubular body forms a nip with a pressurizing member. The tubular body is formed in a tubular shape. The tubular body fixes, at the nip, a recording material on a recording medium. The heater is disposed inside the tubular body. The heater faces a part of the tubular body in a circumferential direction. The heater heats the tubular body. The heat conductive member is disposed on an opposite side of a side where the heater faces the tubular body. Printing may be continuously performed on a small-size paper as a recording medium. When a paper passes through an axial center portion of the tubular body, heat of the tubular body escapes to the paper, and a temperature at the axial center portion of the tubular body drops. When the temperature at the axial center portion of the tubular body drops excessively, a fixing failure may occur. Therefore, a fixing device is required to prevent occurrence of the fixing failure.

DETAILED DESCRIPTION

In general, according to one embodiment, a fixing device includes a tubular body, a heater, a heat equalizing member, and a heat conductive member. The tubular body forms a nip with a pressurizing member. The tubular body is formed in a tubular shape. The tubular body fixes, at the nip, a recording material on a recording medium. The heater is disposed inside the tubular body. The heater faces a part of the tubular body in a circumferential direction. The heater heats the tubular body. The heat equalizing member is disposed on an opposite side of a side where the heater faces the tubular body. The heat equalizing member transfers heat from a place having a high temperature to a place having a low temperature in a second direction along an axial direction of the tubular body. The heat conductive member is disposed between the heater and the heat equalizing member. The heat conductive member can conduct the heat in each of the second direction and a first direction in which the heater and the heat equalizing member face each other. A side portion of the heat conductive member in the second direction is divided into three or more portions.

Hereinafter, an image forming apparatus according to a first embodiment will be described with reference to the drawings.

Figure 1:
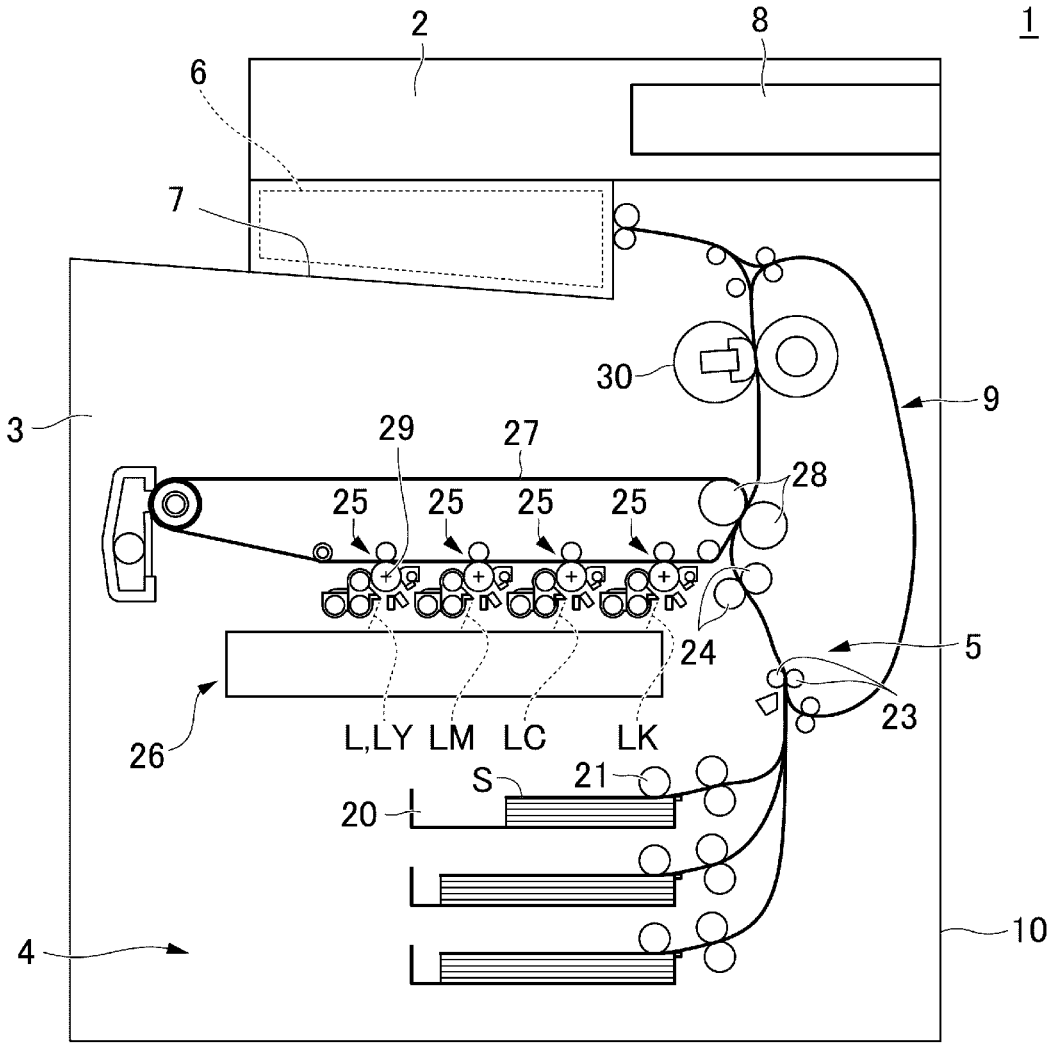
FIG. 1 illustrates a schematic configuration diagram of an image forming apparatus according to a first embodiment.

FIG. 1 illustrates a schematic configuration diagram of an image forming apparatus 1 according to the first embodiment.

As illustrated in FIG. 1, the image forming apparatus 1 includes a housing 10, a scanner unit 2, an image forming unit 3, a sheet supply unit 4, a transport unit 5, a paper discharge tray 7, an inversion unit 9, a control panel 8, and a control unit 6. The image forming apparatus 1 forms an image on a sheet-shaped recording medium (hereinafter, referred to as a "sheet") such as a paper.

The housing 10 forms an outer shape of the image forming apparatus 1. The housing 10 houses components of the image forming apparatus 1.

The scanner unit 2 reads, as an intensity of light, image information of an object to be copied, and generates an image signal. The scanner unit 2 outputs the generated image signal to the image forming unit 3.

The image forming unit 3 forms an output image to a recording material such as a toner based on the image signal received from the scanner unit 2 or an image signal received from the outside. Hereinafter, the output image is referred to as a toner image. The image forming unit 3 transfers the toner image onto a surface of a sheet S. The image forming unit 3 heats and pressurizes the toner image on the surface of the sheet S to fix the toner image on the sheet S. The image forming unit 3 forms an image on the sheet S.

The sheet supply unit 4 supplies the sheet S one by one to the transport unit 5 when the image forming unit 3 forms the toner image. The sheet supply unit 4 includes a sheet housing portion 20 and a pickup roller 21.

The sheet housing portion 20 houses the sheet S of a predetermined size and type.

The pickup roller 21 takes out the sheet S one by one from the sheet housing portion 20. The pickup roller 21 supplies the taken-out sheet S to the transport unit 5.

The transport unit 5 transports the sheet S supplied from the sheet supply unit 4 to the image forming unit 3. The transport unit 5 includes a transport roller 23 and a resist roller 24.

The transport roller 23 transports the sheet S supplied from the pickup roller 21 to the resist roller 24. The transport roller 23 abuts a tip of the sheet S in a transport direction against a nip of the resist roller 24.

The resist roller 24 adjusts a position of the tip of the sheet S in the transport direction by bending the sheet S at the nip. The resist roller 24 transports the sheet S when the image forming unit 3 transfers the toner image on the sheet S.

The image forming unit 3 will be described below.

The image forming unit 3 includes a plurality of image forming portions 25, a laser scanning unit 26, an intermediate transfer belt 27, a transfer portion 28, and a fixing device 30.

The image forming portion 25 includes a photoreceptor drum 29. The image forming portion 25 forms, on the photoreceptor drum 29, the toner image corresponding to the image signal from the scanner unit 2 or the outside. The plurality of image forming portions 25 form toner images with yellow, magenta, cyan, and black toners.

A charger, a developing device, and the like are disposed around the photoreceptor drum 29. The charger charges a surface of the photoreceptor drum 29. The developing device houses a developer containing the yellow, magenta, cyan, and black toners. The developing device develops an electrostatic latent image on the photoreceptor drum 29. The photoreceptor drum 29 is formed with the toner image using the toner of each color.

The laser scanning unit 26 scans the charged photoreceptor drum 29 with a laser beam L to expose the photoreceptor drum 29. The photoreceptor drums 29 of the image forming portions 25 of all the colors are exposed with different laser beams LY, LM, LC, and LK by the laser scanning unit 26, respectively. The laser scanning unit 26 forms the electrostatic latent image on the photoreceptor drum 29.

The intermediate transfer belt 27 primarily transfers the toner image on the surface of the photoreceptor drum 29.

The transfer portion 28 transfers, onto the surface of the sheet S at a secondary transfer position, the toner image primarily transferred onto the intermediate transfer belt 27.

The fixing device 30 heats and pressurizes the toner image transferred on the sheet S to fix the toner image on the sheet S.

The inversion unit 9 inverts the sheet S in order to form an image on a back surface of the sheet S. The inversion unit 9 inverts the sheet S discharged from the fixing device 30 upside down by switchback. The inversion unit 9 transports the reversed sheet S toward the resist roller 24.

The paper discharge tray 7 is placed with the discharged sheet S on which the image is formed.

The control panel 8 is a part of an input unit that inputs information for an operator to operate the image forming apparatus 1. The control panel 8 includes a touch panel and various hard keys.

The control unit 6 controls each unit of the image forming apparatus 1.

Figure 2:
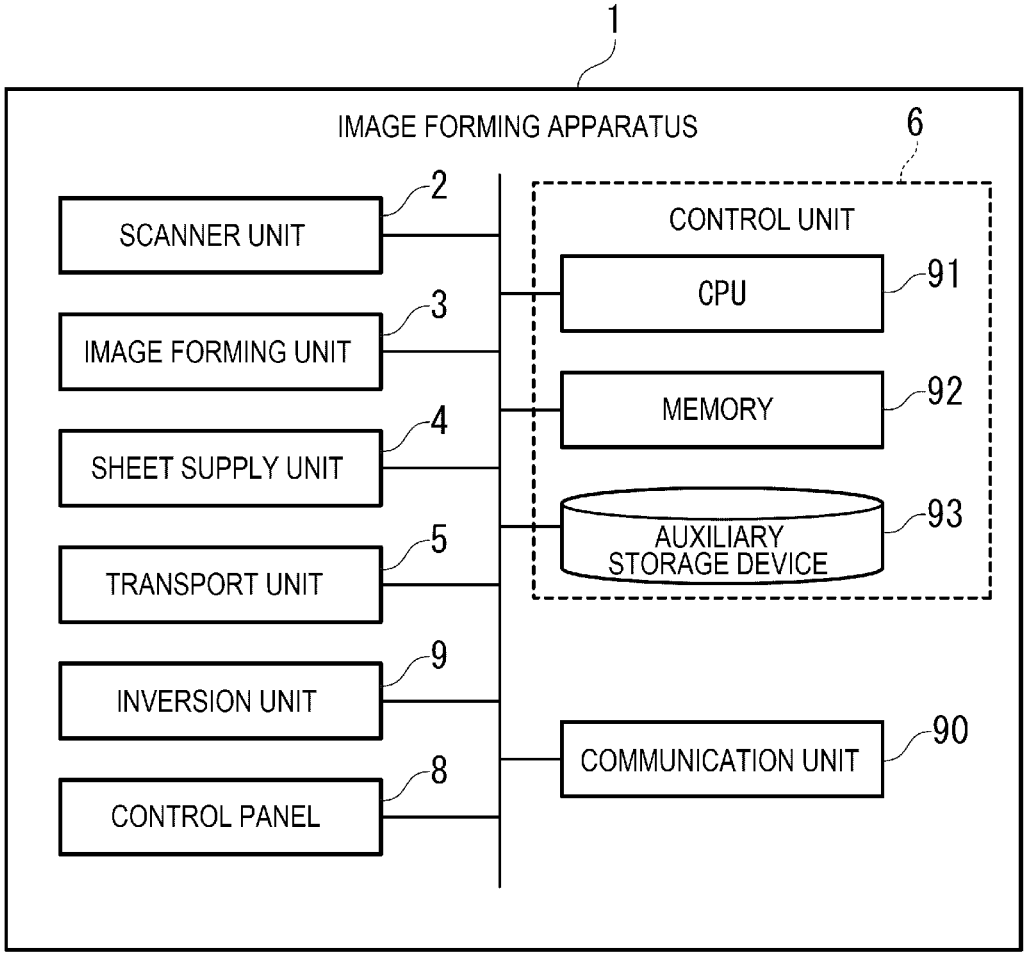
FIG. 2 illustrates a hardware configuration diagram of the image forming apparatus.

FIG. 2 illustrates a hardware configuration diagram of the image forming apparatus 1 according to the first embodiment.

As illustrated in FIG. 2, the image forming apparatus 1 includes a central processing unit (CPU) 91, a memory 92, and an auxiliary storage device 93. The CPU 91, the memory 92, and the auxiliary storage device 93 are connected via a bus. The image forming apparatus 1 executes various programs. The image forming apparatus 1 functions as an apparatus including the scanner unit 2, the image forming unit 3, the sheet supply unit 4, the transport unit 5, the inversion unit 9, the control panel 8, and a communication unit 90 by executing the programs.

The CPU 91 functions as the control unit 6 by executing the programs stored in the memory 92 and the auxiliary storage device 93. The control unit 6 controls an operation of each functional unit of the image forming apparatus 1.

The auxiliary storage device 93 is formed by a storage device such as a magnetic hard disk device or a semiconductor storage device. The auxiliary storage device 93 stores information.

The communication unit 90 includes a communication interface that connects the own device to an external device. The communication unit 90 communicates with the external device via the communication interface.

The fixing device 30 will be described in detail.

Figure 3:
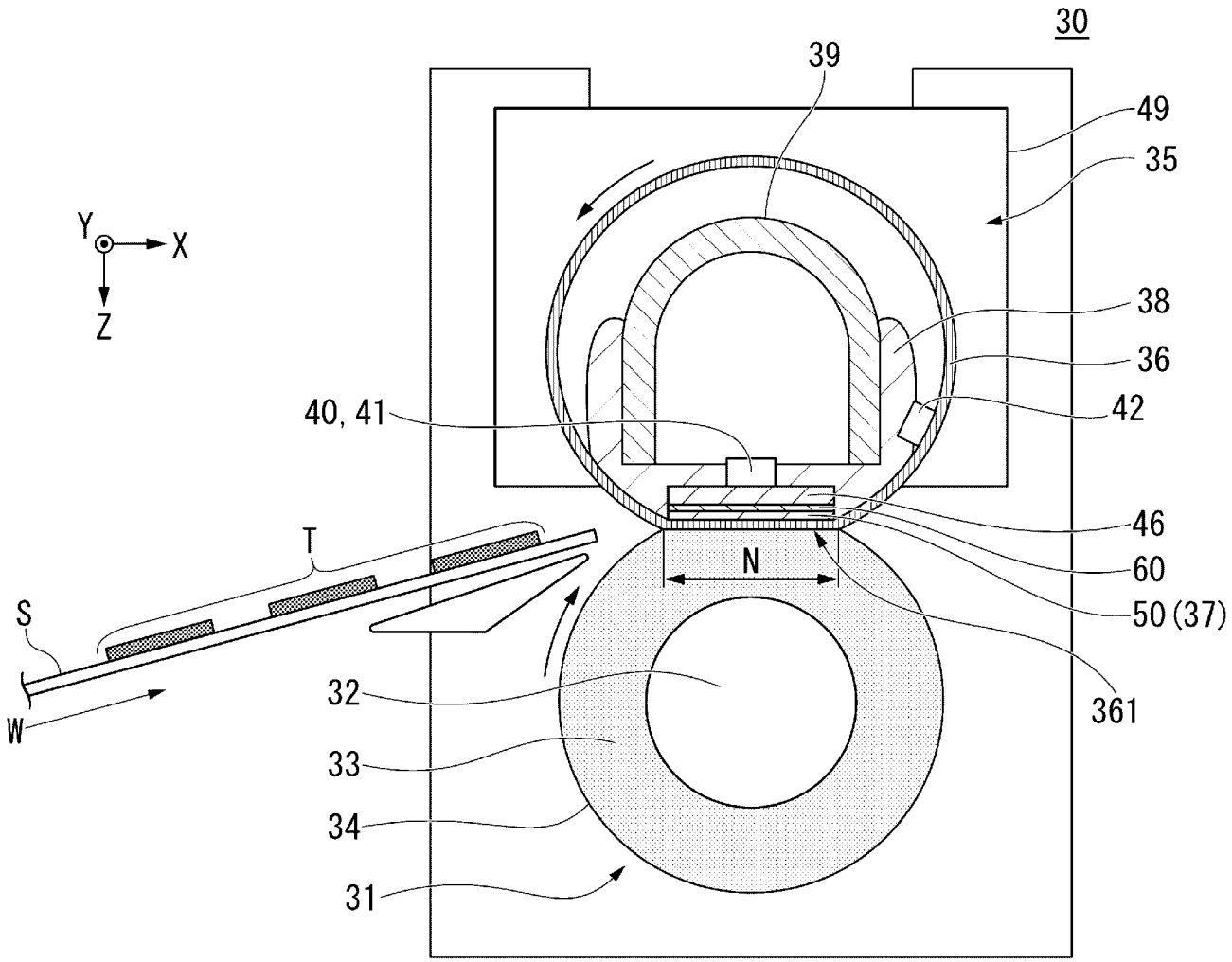
FIG. 3 illustrates an XZ cross-sectional view of a fixing device.

FIG. 3 illustrates an XZ cross-sectional view of the fixing device 30 according to the first embodiment.

As illustrated in FIG. 3, the fixing device 30 includes a pressure roller 31 (an example of the pressurizing member) and a heating mechanism 35.

The pressure roller 31 forms a nip N with the heating mechanism 35. The pressure roller 31 pressurizes a toner image T on the sheet S that entered the nip N. The pressure roller 31 rotates to transport the sheet S. The pressure roller 31 includes a core metal 32, an elastic layer 33, and a release layer 34.

The core metal 32 is made of a metal material such as stainless steel. The core metal 32 has a cylindrical shape. Both ends of the core metal 32 in an axial direction are rotatably supported. The core metal 32 is rotationally driven by a motor. The core metal 32 is in contact with a cam member. The cam member rotates to bring the core metal 32 closer to and away from the heating mechanism 35.

The elastic layer 33 is made of an elastic material such as silicone rubber. The elastic layer 33 is formed on an outer peripheral surface of the core metal 32 with a constant thickness. The elastic layer 33 has a cylindrical shape along the core metal 32.

The release layer 34 is made of a resin material such as PFA (tetrafluoroethylene-perfluoroalkyl vinyl ether copolymer). The release layer 34 is formed on an outer peripheral surface of the elastic layer 33.

A hardness of the outer peripheral surface of the pressure roller 31 is preferably 40° to 70° under a load of 9.8 N with ASKER-Ch. Accordingly, an area of the nip N is ensured. Moreover, durability of the pressure roller 31 is ensured.

The pressure roller 31 can approach and separate from the heating mechanism 35 by a rotation of the cam member. When the pressure roller 31 approaches the heating mechanism 35 and is pressed by a pressure spring, the nip N is formed. On the other hand, when the sheet S is jammed in the fixing device 30, the sheet S can be removed by separating the pressure roller 31 from the heating mechanism 35. By separating the pressure roller 31 from the heating mechanism 35 in a state where a tubular body 36 of the fixing device 30 is stopped rotating, such as during sleep, plastic deformation of the tubular body 36 is prevented.

The pressure roller 31 is rotationally driven by the motor to rotate. When the pressure roller 31 rotates in a state where the nip N is formed, the tubular body 36 of the heating mechanism 35 is driven to rotate. The pressure roller 31 rotates in a state where the sheet S is disposed on the nip N, whereby the sheet S is transported in a transport direction W.

The heating mechanism 35 heats the toner image T on the sheet S that entered the nip N. The heating mechanism 35 includes the tubular body 36, a heater 37, a heat equalizing member 46, a heat conductive member 60, a support member 38, a stay 39, a thermostat unit 40, a first temperature detection member 41, and a second temperature detection member 42.

Hereinafter, an XYZ coordinate system may be used for explaining a configuration of the fixing device 30. In the embodiment, an X direction, a Y direction, and a Z direction are defined as follows. The X direction corresponds to a direction along a lateral direction of the heater 37. The Y direction corresponds to a direction along a longitudinal direction of the heater 37. The Y direction corresponds to a second direction along an axial direction of the tubular body 36. In the present embodiment, the Y direction is orthogonal to the transport direction W of the sheet S. The Z direction corresponds to a direction orthogonal to the X direction and the Y direction. The Z direction corresponds to a first direction in which the heater 37 and the heat equalizing member 46 face each other. Hereinafter, in the X direction, one side is referred to as a +X side and the other side is referred to as a −X side. In the Y direction, one side is referred to as a +Y side and the other side is referred to as a −Y side. In the Z direction, one side is referred to as a +Z side and the other side is referred to as a −Z side.

The tubular body 36 is formed in a tubular shape by a film or the like. The tubular body 36 has an endless peripheral surface. The tubular body 36 has flexibility. The tubular body 36 forms the nip N with the pressure roller 31. The tubular body 36 fixes, at the nip N, the toner image T on the sheet S. The tubular body 36 is an endless belt (fixing belt) of the fixing device 30.

The tubular body 36 includes a base layer, an elastic layer, and a release layer in this order from an inner peripheral side. The base layer is made of a material such as a polyimide resin. The base layer has a tubular shape extending in the Y direction. The elastic layer is laminated and disposed on an outer peripheral surface of the base layer. The elastic layer is made of an elastic material such as silicone rubber. The release layer is laminated and disposed on an outer peripheral surface of the elastic layer. The release layer is made of a material such as a PFA resin.

The heater 37 is disposed inside the tubular body 36. The heater 37 faces a heated region 361, which is a part of the tubular body 36 in a circumferential direction. The heater 37 heats the heated region 361. The heater 37 is disposed inside a portion where the tubular body 36 faces the pressure roller 31 so as to face the nip N.

A lubricant is applied onto an inner peripheral surface of the tubular body 36. The heater 37 is in contact with the inner peripheral surface of the tubular body 36 via the lubricant. When the heater 37 generates heat, the viscosity of the lubricant decreases. Accordingly, slidability between the heater 37 and the tubular body 36 is ensured. The tubular body 36 slides on a surface (+Z side surface) of the heater 37 while one surface of the tubular body 36 is in contact with the heater 37.

The heat equalizing member 46 is disposed on an opposite side of a side where the heater 37 faces the tubular body 36. The heat equalizing member 46 is disposed on a heat conductive member 60 side opposite to the heater 37. The heat equalizing member 46 transfers heat from a place having a high temperature to a place having a low temperature in the Y direction along the axial direction of the tubular body 36.

The heat equalizing member 46 is a thin plate or steel plate made of a metal material such as copper or aluminum, or a heat pipe. The heat equalizing member 46 in the present embodiment is a heat pipe. For example, the heat equalizing member 46 may have a plate shape by arranging, in the X direction, a plurality of heat pipes whose longitudinal directions are the Y direction. An outer shape of the heat equalizing member 46 is the same as an outer shape of the heater 37. The heat equalizing member 46 has an isotropic thermal conductivity. The thermal conductivity of the heat equalizing member 46 is substantially constant regardless of a direction.

A length of the heat equalizing member 46 in the X direction is substantially the same as a length of the heat conductive member 60 in the X direction. In the X direction, a center of the heat conductive member 60 and a center of the heat equalizing member 46 coincide with each other.

A thickness of the heat equalizing member 46 in the Z direction is larger than a thickness of the heat conductive member 60 in the Z direction. For example, the thickness of the heat equalizing member 46 in the Z direction is preferably 1 mm or more and 2 mm or less. Accordingly, it is possible to prevent the heat equalizing member 46 from being too thick in the Z direction. Therefore, it is possible to prevent a heat capacity of the heat equalizing member 46 from being excessively large and a heat equalizing property thereof from deteriorating.

The heat conductive member 60 is disposed between the heater 37 and the heat equalizing member 46. The heat conductive member 60 can conduct the heat in each of the X direction, the Y direction, and the Z direction. The heat conductive member 60 faces the heated region 361 via the heater 37. The heat conductive member 60 is in direct contact with each of the heater 37 and the heat equalizing member 46 in the Z direction. The heat conductive member 60 is sandwiched in the Z direction by the heater 37 and the heat equalizing member 46. The heat conductive member 60 may be fixed at a fixed position by being sandwiched in the Z direction by a predetermined pressure.

A thickness of the heat conductive member 60 in the Z direction is smaller than the thickness of the heat equalizing member 46 in the Z direction. For example, the thickness of the heat conductive member 60 in the Z direction is 10 μm (micrometer) or more and 500 μm or less.

The heat conductive member 60 is a member that can transfer the heat. For example, the heat conductive member 60 is a graphite sheet, a curable heat conductive grease, or the like. The heat conductive member 60 is a non-electrically conductive elastic member. For example, the heat conductive member 60 is non-electrically conductive that is inferior in conductivity to the heat equalizing member 46 and is an elastic body that is more flexible than the heat equalizing member 46. For example, the heat conductive grease may be of a room temperature curing or thermosetting type.

The heat conductive member 60 is compressively deformable when the sheet S passes through the nip N. Therefore, the heat conductive member 60 is crushed in the thickness direction (Z direction) when a pressure nip is formed. Therefore, adhesion of the heat conductive member 60 to the heater 37 and the heat equalizing member 46 can be enhanced. Therefore, an efficient thermal conductivity can be obtained.

For example, the heat conductive member 60 is preferably an elastic heat conductive sheet. Accordingly, it is possible to absorb thermal expansion due to heating of the heat equalizing member 46, warpage of the heater 37, and the like by elastic deformation of the heat conductive member 60. Therefore, it is not necessary to improve surface accuracy of the heat equalizing member 46 and straightness accuracy of the support member 38 that supports the heat equalizing member 46.

For example, the heat conductive member 60 is preferably a heat conductive sheet having no electrical conductivity. Since the heater 37 is heated by energization, the surface of the heater 37 may be damaged. In this case, when the heat conductive member 60 is a heat conductive sheet having electrical conductivity, a problem such as a short circuit may occur due to energization from the heater 37 to the heat equalizing member 46. In contrast, when the heat conductive member 60 is a heat conductive sheet having no electrical conductivity, the energization from the heater 37 is not conducted to the heat equalizing member 46. Therefore, it is possible to avoid the problem such as a short circuit.

The support member 38 is made of a resin material such as a liquid crystal polymer. The support member 38 is disposed so as to cover the −Z side of the heat equalizing member 46 and both sides thereof in the X direction. The support member 38 supports the heater 37 via the heat equalizing member 46 and the heat conductive member 60. Round chamfers are formed at both ends of the support member 38 in the X direction. The support member 38 supports the inner peripheral surface of the tubular body 36 at both ends of the heater 37 in the X direction.

The stay 39 is made of a steel plate material or the like. A cross section of the stay 39 along an XZ plane is formed in a U shape. The stay 39 is mounted on the −Z side of the support member 38 so as to close a U-shaped opening with the support member 38. The stay 39 extends in the Y direction. Both ends of the stay 39 in the Y direction are fixed to the housing 10 of the image forming apparatus 1. Accordingly, the heating mechanism 35 is supported by the image forming apparatus 1. The stay 39 improves bending rigidity of the heating mechanism 35. A flange 49 that restricts a movement of the tubular body 36 in the Y direction is mounted near the both ends of the stay 39 in the Y direction.

Figure 4:
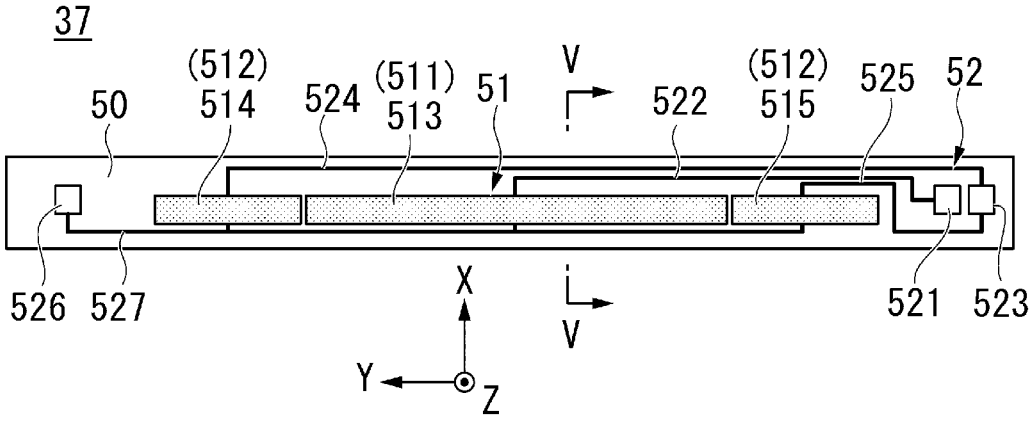
FIG. 4 illustrates a plan view of a heater.
Figure 5:
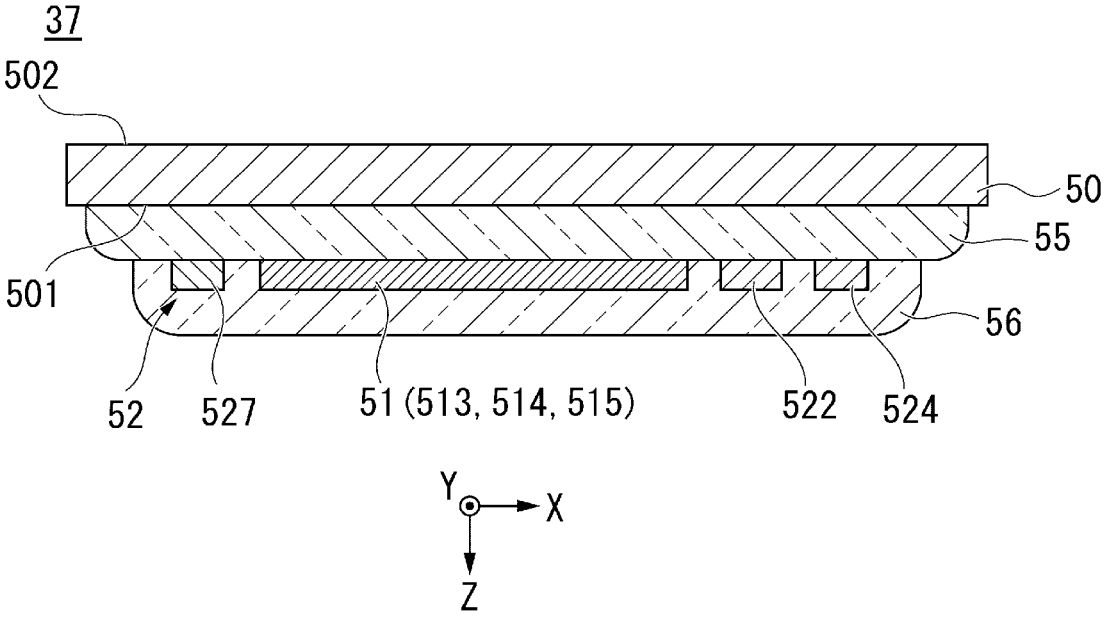
FIG. 5 illustrates a sectional view along a line V-V in FIG. 4.

FIG. 4 illustrates a plan view of the heater 37 according to the embodiment. FIG. 5 illustrates a sectional view along a line V-V in FIG. 4.

As illustrated in FIG. 4, the heater 37 includes a substrate 50, a heat generating member 51, and a wiring set 52.

The substrate 50 is made of a metal material such as stainless steel or a ceramic material such as aluminum nitride. The substrate 50 is formed in a rectangular plate shape along the Y direction. The substrate 50 is disposed on a radial inner side (−Z side) of the tubular body 36. In the substrate 50, the axial direction of the tubular body 36 is defined as a longitudinal direction.

As illustrated in FIG. 5, the substrate 50 includes a first surface 501 and a second surface 502 which face to opposite directions. The first surface 501 is a surface facing the +Z side. The second surface 502 is a surface facing the −Z side. An insulating layer 55 made of a glass material or the like is formed on the first surface 501 of the substrate 50. In the heater 37 according to the embodiment, the first surface 501 side of the substrate 50 is in contact with the inner peripheral surface of the tubular body 36.

The heat generating member 51 and the wiring set 52 are disposed on the substrate 50 via the insulating layer 55. The heat generating member 51 and the wiring set 52 are provided on a +Z side surface of the insulating layer 55. The heat generating member 51 and the wiring set 52 are covered with a protective layer 56 made of a glass material or the like.

As illustrated in FIG. 4, the heat generating member 51 includes a first heat generating portion 511 and second heat generating portions 512. The first heat generating portion 511 and the second heat generating portions 512 are made of a resistance temperature coefficient (TCR) material. For example, the first heat generating portion 511 and the second heat generating portions 512 are made of a silver-palladium alloy or the like.

The first heat generating portion 511 according to the embodiment includes a central heating element 513. The central heating element 513 is disposed at a center of the substrate 50 in a longitudinal direction (Y direction). An outer shape of the central heating element 513 is a rectangular shape having a long side along the Y direction and a short side along the X direction. The central heating element 513 is disposed along the longitudinal direction of the substrate 50.

The second heat generating portions 512 according to the embodiment include a first end heating element 514 and a second end heating element 515. The first end heating element 514 and the second end heating element 515 are disposed at ends of the substrate 50 in the longitudinal direction (Y direction). An outer shape of each of the first end heating element 514 and the second end heating element 515 is a rectangular shape having a long side along the Y direction and a short side along the X direction. A Y-direction dimension of each of the first end heating element 514 and the second end heating element 515 is smaller than a Y-direction dimension of the central heating element 513. An X-direction dimension of each of the first end heating element 514 and the second end heating element 515 is equal to an X-direction dimension of the central heating element 513.

The first end heating element 514 is disposed on an end of the substrate 50 in a +Y side of the longitudinal direction (Y direction). The second end heating element 515 is disposed on an end of the substrate 50 in a −Y side of the longitudinal direction (Y direction). The first end heating element 514 is disposed on a +Y side with respect to the central heating element 513. The second end heating element 515 is disposed on a −Y side with respect to the central heating element 513. The first end heating element 514 and the second end heating element 515 are located on outer sides (+Y side or −Y side) of the substrate 50 in the longitudinal direction with respect to the central heating element 513.

The wiring set 52 is made of a metal material such as silver. The wiring set 52 includes a central contact 521, a central wiring 522, an end contact 523, a first end wiring 524, a second end wiring 525, a common contact 526, and a common wiring 527.

The central contact 521 is disposed on a −Y side of the heat generating member 51. The central contact 521 supplies a power to the central heating element 513 via the central wiring 522.

The central wiring 522 is disposed on a +X side of the heat generating member 51. The central wiring 522 connects an end side of the central heating element 513 on a +X side with the central contact 521.

The end contact 523 is disposed on a −Y side of the central contact 521. The end contact 523 supplies a power to the end heating elements 514 and 515 via the end wirings 524 and 525.

The first end wiring 524 is disposed on a +X side of the central wiring 522, which is the +X side of the heat generating member 51. The first end wiring 524 connects an end side of the first end heating element 514 on the +X side with an end of the end contact 523 on the +X side.

The second end wiring 525 is disposed on a −X side of the central wiring 522, which is the +X side of the heat generating member 51. The second end wiring 525 connects an end side of the second end heating element 515 on the +X side with an end of the end contact 523 on the −X side.

The common contact 526 is disposed on a +Y side of the heat generating member 51.

The common wiring 527 is disposed on the −X side of the heat generating member 51. The common wiring 527 connects end sides of the central heating element 513, the first end heating element 514, and the second end heating element 515 on the −X side to the common contact 526.

In the present embodiment, the heat generating member 51 generates heat when is energized. An electrical resistance value of the central heating element 513 is smaller than electrical resistance values of the first end heating element 514 and the second end heating element 515. In the present embodiment, a narrow sheet whose width in the Y direction is smaller than a predetermined width passes through a central portion of the fixing device 30 in the Y direction. In this case, the control unit 6 only causes the central heating element 513 to generate heat. On the other hand, when a wide sheet has a width larger than the predetermined width in the Y direction, the control unit 6 causes the entire heat generating member 51 to generate heat. That is, in the case of a wide sheet, the control unit 6 causes the central heating element 513, the first end heating element 514, and the second end heating element 515 to generate heat.

In the present embodiment, heat generation of the central heating element 513, the first end heating element 514, and the second end heating element 515 can be controlled independently of each other. In the present embodiment, heat generation of the first end heating element 514 and the second end heating element 515 are similarly controlled.

As illustrated in FIG. 3, the thermostat unit 40 and the first temperature detection member 41 are disposed on a −Z side of the heater 37 with the heat equalizing member 46 and the heat conductive member 60 sandwiched therebetween. For example, the first temperature detection member 41 is a thermistor. The thermostat unit 40 and the first temperature detection member 41 are mounted and supported on a surface of the support member 38 on the −Z side. Temperature sensitive elements of the thermostat unit 40 and the first temperature detection member 41 are be in contact with the heat equalizing member 46 through a hole penetrating the support member 38 in the Z direction. The thermostat unit 40 and the first temperature detection member 41 measure a temperature of the heater 37 via the heat equalizing member 46 and the heat conductive member 60.

Figure 6:
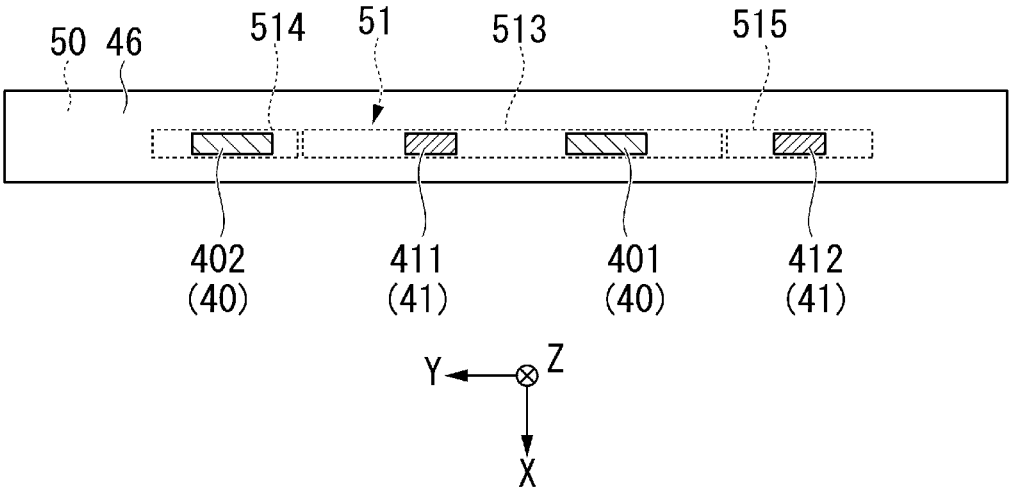
FIG. 6 is a view illustrating disposition of a thermostat unit and a first temperature detection unit.

FIG. 6 is a view showing disposition of the thermostat unit 40 and the first temperature detection unit 41. FIG. 6 corresponds to a plan view of the thermostat unit 40 and the first temperature detection unit 41 as viewed from the −Z side. In FIG. 6, the support member 38 is not illustrated. The following description regarding the disposition of the thermostat unit 40 and the first temperature detection unit 41 describes disposition of temperature sensitive elements.

As illustrated in FIG. 6, the first temperature detection member 41 includes a central heater thermometer 411 and an end heater thermometer 412. The central heater thermometer 411 and the end heater thermometer 412 are disposed apart from each other in the Y direction. The central heater thermometer 411 and the end heater thermometer 412 are disposed within a range of the heat generating member 51 in the Y direction. The central heater thermometer 411 and the end heater thermometer 412 are disposed at a center of the heat generating member 51 in the X direction. Seen from the Z direction, the central heater thermometer 411 and the end heater thermometer 412 overlap at least a part of the heat generating member 51.

The central heater thermometer 411 measures a temperature of the central heating element 513. The central heater thermometer 411 is disposed within a range of the central heating element 513. Seen from the Z direction, the central heater thermometer 411 overlaps the central heating element 513.

The end heater thermometer 412 measures a temperature of the second end heating element 515. Since the first end heating element 514 and the second end heating element 515 are similarly controlled to generate heat by the control unit 6, a temperature of the first end heating element 514 and the temperature of the second end heating element 515 are equivalent to each other. The end heater thermometer 412 is disposed within a range of the second end heating element 515. Seen from the Z direction, the end heater thermometer 412 overlaps the second end heating element 515. An end heater thermometer that measures the temperature of the first end heating element 514 may be provided separately from the end heater thermometer 412.

The thermostat unit 40 cuts off the energization of the heat generating member 51 when the temperature of the heater 37 detected via the heat equalizing member 46 and the heat conductive member 60 is higher than a predetermined temperature. The thermostat unit 40 includes a central thermostat 401 and an end thermostat 402. The thermostat unit 40 is also disposed in the same manner as the first temperature detection member 41 described above.

The central thermostat 401 cuts off the energization of the heat generating member 51 when the temperature of the central heating element 513 is higher than the predetermined temperature. The central thermostat 401 is disposed within the range of the central heating element 513. Seen from the Z direction, the central thermostat 401 overlaps the central heating element 513.

The end thermostat 402 cuts off the energization of the heat generating member 51 when the temperature of the first end heating element 514 is higher than the predetermined temperature. Since the first end heating element 514 and the second end heating element 515 are similarly controlled to generate heat, the temperature of the first end heating element 514 and the temperature of the second end heating element 515 are equivalent to each other. The end thermostat 402 is disposed within a range of the first end heating element 514. Seen from the Z direction, the end thermostat 402 overlaps the first end heating element 514.

In the heater 37 according to the present embodiment, the temperature of the central heating element 513 is controlled by disposing the central heater thermometer 411 and the central thermostat 401 within the range of the central heating element 513. In addition, in the heater 37 according to the present embodiment, the temperatures of the first end heating element 514 and the second end heating element 515 are controlled by disposing the end thermostat 402 and the end heater thermometer 412 within the ranges of the first end heating element 514 and the second end heating element 515.

As illustrated in FIG. 3, the second temperature detection member 42 is disposed on a +X side inside the tubular body 36. The second temperature detection member 42 measures a temperature of the tubular body 36 by coming into contact with the inner peripheral surface of the tubular body 36. The second temperature detection member 42 corresponds to a belt thermometer that measures a temperature of the fixing belt as the tubular body 36.

Figure 7:
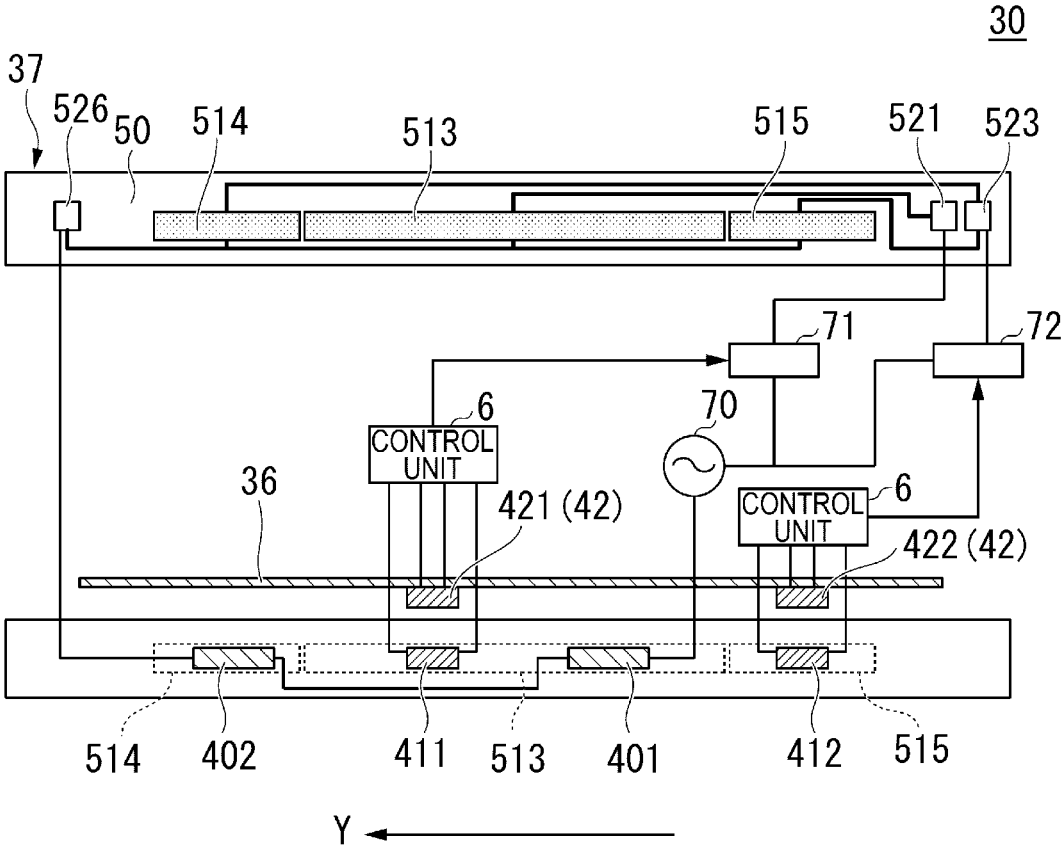
FIG. 7 illustrates an electrical circuit diagram of the fixing device.

FIG. 7 illustrates an electrical circuit diagram of the fixing device 30. In FIG. 7, the plan view in FIG. 6 is disposed at a lower part of the paper, and the plan view in FIG. 4 is disposed at an upper part of the paper. FIG. 7 illustrates the second temperature detection member 42 together with a cross section of the tubular body 36 above the plan view at the lower part. The second temperature detection member 42 includes a central belt thermometer 421 and an end belt thermometer 422.

The central belt thermometer 421 is in contact with a central portion of the tubular body 36 in the Y direction. The central belt thermometer 421 is in contact with the tubular body 36 within a range of the central heating element 513 in the Y direction. The central belt thermometer 421 measures a temperature of a central portion of the tubular body 36 in the Y direction.

The end belt thermometer 422 is in contact with an end of the tubular body 36 on the −Y side. The end belt thermometer 422 is in contact with the tubular body 36 within a range of the second end heating element 515 in the Y direction. The end belt thermometer 422 measures a temperature of the end of the tubular body 36 on the −Y side. As described above, the heat generation of the first end heating element 514 and the second end heating element 515 is similarly controlled. In the present embodiment, the temperature of the end of the tubular body 36 on the −Y side and a temperature of the end thereof on the +Y side are equivalent to each other.

A power supply 70 is connected to the central contact 521 via a central triac 71. The power supply 70 is connected to the end contact 523 via an end triac 72. The control unit 6 controls ON/OFF of the central triac 71 and the end triac 72 independently of each other.

When the control unit 6 turns on the central triac 71, the power supply 70 energizes the central heating element 513. Accordingly, the central heating element 513 generates heat. When the control unit 6 turns on the end triac 72, the power supply 70 energizes the first end heating element 514 and the second end heating element 515. Accordingly, the first end heating element 514 and the second end heating element 515 generate heat. As described above, the central heating element 513, the first end heating element 514, and the second end heating element 515 are controlled to generate heat independently of each other. The central heating element 513, the first end heating element 514, and the second end heating element 515 are connected in parallel to the power supply 70.

The power supply 70 is connected to the common contact 526 via the central thermostat 401 and the end thermostat 402. The central thermostat 401 and the end thermostat 402 are connected in series.

When the temperature of the central heating element 513 rises abnormally, a detected temperature of the central thermostat 401 is higher than the predetermined temperature. At this time, the central thermostat 401 cuts off energization from the power supply 70 to the entire heat generating member 51.

When the temperature of the first end heating element 514 rises abnormally, a detected temperature of the end thermostat 402 is higher than the predetermined temperature. At this time, the end thermostat 402 cuts off the energization from the power supply 70 to the entire heat generating member 51. As described above, the heat generation of the first end heating element 514 and the second end heating element 515 is similarly controlled. Therefore, when the temperature of the second end heating element 515 rises abnormally, the temperature of the first end heating element 514 also rises. Therefore, when the temperature of the second end heating element 515 rises abnormally, the end thermostat 402 also cuts off the energization from the power supply 70 to the heat generating member 51.

The control unit 6 acquires the temperature of the central heating element 513 by the central heater thermometer 411. The control unit 6 acquires the temperature of the second end heating element 515 by the end heater thermometer 412. The temperature of the second end heating element 515 is equivalent to the temperature of the first end heating element 514. The control unit 6 measures a temperature of the heat generating member 51 by the heater thermometers 411 and 412 at the time of starting (warming up) the fixing device 30 and returning from a paused state (sleep state) thereof.

At the time of starting the fixing device 30 and returning from the paused state, when the temperature of at least one of the central heating element 513 and the second end heating element 515 is lower than the predetermined temperature, the control unit 6 causes the heat generating member 51 to generate heat for a short time. Thereafter, the control unit 6 starts rotation of the pressure roller 31. Due to the heat generated by the heat generating member 51, the viscosity of the lubricant applied to the inner peripheral surface of the tubular body 36 decreases. Accordingly, the slidability between the heater 37 and the tubular body 36 at the start of rotation of the pressure roller 31 is ensured.

The control unit 6 acquires the temperature of the central portion of the tubular body 36 in the Y direction by the central belt thermometer 421. The control unit 6 acquires the temperature of the end of the tubular body 36 on the −Y side by the end belt thermometer 422. The temperature of the end of the tubular body 36 on the −Y side is equivalent to the temperature of the end of the tubular body 36 on the +Y side. The control unit 6 acquires the temperatures of the central portion and the end of the tubular body 36 in the Y direction when the fixing device 30 is operated.

The control unit 6 phase-controls or wave-number-controls the power supplied to the heat generating member 51 by the central triac 71 and the end triac 72. The control unit 6 controls energization of the central heating element 513 based on the temperature of the central portion of the tubular body 36 in the Y direction. The control unit 6 controls the energization to the first end heating element 514 and the second end heating element 515 based on the temperature of the end of the tubular body 36 in the Y direction.

Figure 8:
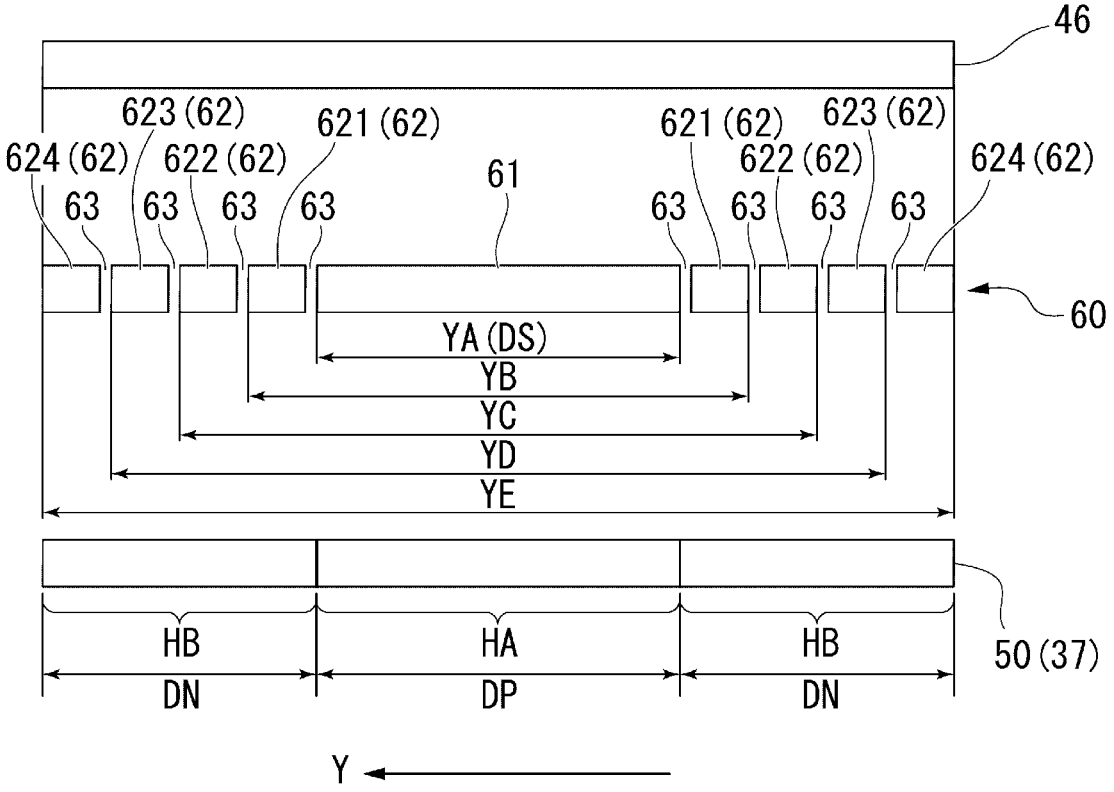
FIG. 8 is a view illustrating disposition of a heat conductive member.

FIG. 8 is a view illustrating disposition of the heat conductive member 60. FIG. 8 illustrates a plan view of the substrate 50 of the heater 37 below a plan view of the heat conductive member 60 on the paper. In addition, FIG. 8 illustrates a plan view of the heat equalizing member 46 above the plan view of the heat conductive member 60 on the paper.

As illustrated in FIG. 8, the length of the heat equalizing member 46 in the longitudinal direction is substantially the same as a length of the substrate 50 in the longitudinal direction. Positions of both ends of the heat conductive member 60 in the longitudinal direction are substantially the same as positions of both ends of the substrate 50 in the longitudinal direction. A thermal conductivity of the heat conductive member 60 is higher than that of the substrate 50. For example, the thermal conductivity of the heat conductive member 60 is 3 W/(m·K) or more. When the heat conductive member 60 is a graphite sheet, the heat conductive member 60 has an anisotropic thermal conductivity. A thermal conductivity of the graphite sheet in the Z direction is 3 W/(m·K) or more and 20 W/(m·K) or less. Thermal conductivities of the graphite sheet in the X direction and the Y direction are 300 W/(m·K) or more and 2000 W/(m·K) or less, respectively.

Positions of both ends of the heat equalizing member 46 in the longitudinal direction are substantially the same as the positions of the both ends of the heat conductive member 60 in the longitudinal direction. A thermal conductivity of the heat equalizing member 46 is higher than that of the heat conductive member 60. For example, when the heat equalizing member 46 is a heat pipe, the heat equalizing member 46 has a thermal conductivity 10 times or more that of copper.

A side portion of the heat conductive member 60 in the Y direction is divided into three or more portions. The side portion of the heat conductive member 60 in the Y direction means a portion between a central portion of the heat conductive member 60 in the Y direction and an outer end thereof in the Y direction. In an example of FIG. 8, the side portion of the heat conductive member 60 in the Y direction is divided into four portions. Adjacent portions obtained by dividing the heat conductive member 60 in the Y direction are separated from each other. The adjacent portions obtained by dividing the heat conductive member 60 in the Y direction are disposed apart at a predetermined gap 63. For example, the size of the gap 63 in the Y direction is about 1 mm.

As described above, the heat conductive member 60 is compressively deformable when the sheet passes through the nip. The heat conductive member 60 is crushed in the thickness direction (Z direction) when the pressure nip is formed. For example, even when the heat conductive member 60 is crushed, the size of the gap 63 in the Y direction is preferably a size at which the adjacent portions obtained by dividing the heat conductive member 60 in the Y direction are separated from each other. Accordingly, even when the pressure nip is formed, the heat conductive member 60 can be maintained in a divided state.

The heat conductive member 60 is divided in the Y direction for each paper passing region (passing region) where the sheet passes through the nip. In the case of paper passing, a user passes sheets of various sizes. Various sizes include an LT size, an A4 size, and the like, which are general standards. Sizes shorter than the general standards include an A4-R size, an LT-R size, and the like. The "-R" at ends means that an orientation of a sheet is reversed by 90 degrees in the case of sheet passing in a vertically long orientation (an orientation in which the sheet is fed from a short side). For example, when an A4 size sheet passes in a vertically long orientation, it is referred to as the A4-R size.

The heat conductive member 60 includes a center member 61 and side members 62. The center member 61 includes a central portion of the heat conductive member 60 in the Y direction. The center member 61 overlaps, when viewed from the Z direction, a minimum width region DS of the heat conductive member 60 on which a sheet having a minimum width passes through the nip. The center member 61 is continuous in the Y direction. For example, a length YA of the center member 61 in the Y direction is a width (148 mm) of an A5-R size. In the example of FIG. 8, the minimum width region DS is a region of the heat conductive member 60 on which the A5-R size sheet passes through the nip.

The side members 62 are separated from the center member 61 in the Y direction. The side members 62 are provided on a +Y side and a −Y side of the center member 61. The side members 62 each include four members obtained by division in the Y direction. The adjacent portions of the four members obtained by division in the Y direction are separated from each other. The four members include a first side member 621, a second side member 622, a third side member 623, and a fourth side member 624. The heat conductive member 60 includes one center member 61, two first side members 621, two second side members 622, two third side members 623, and two fourth side members 624.

In the example of FIG. 8, nine members of the heat conductive member 60 are separated from each other at the gap 63 in the Y direction. The heat conductive member 60 has eight gaps 63. Accordingly, heat conduction of the adjacent portions which are obtained by dividing the heat conductive member 60 in the Y direction is prevented by the gaps 63. For example, the eight gaps 63 have the same size. For example, the size of each gap 63 in the Y direction is about 1 mm.

Hereinafter, the sheet having the minimum width is referred to as a minimum width sheet, a sheet having a width larger than that of the minimum width sheet is referred to as a first width sheet, a sheet having a width larger than that of the first width sheet is referred to as a second width sheet, a sheet having a width larger than that of the second width sheet is referred to as a third width sheet, and a sheet having a width larger than that of the third width sheet is referred to as a fourth width sheet.

The first side members 621 overlap, when viewed from the Z direction, a first width region of the heat conductive member 60 on which the first width sheet passes through the nip. Lengths of the first side members 621 in the Y direction are shorter than a length of the center member 61 in the Y direction. The first side members 621 are disposed outside the center member 61 in the Y direction. For example, a length YB of, in the Y direction, a portion including the center member 61 and the two first side members 621 is a width (182 mm) of a B5-R size.

The second side members 622 overlap, when viewed from the Z direction, a second width region of the heat conductive member 60 on which the second width sheet passes through the nip. The second side members 622 are disposed outside the first side members 621 in the Y direction. For example, a length YC of, in the Y direction, a portion including the center member 61, the two first side members 621, and the two second side members 622 is a width (210 mm) of the A4-R size.

The third side members 623 overlap, when viewed from the Z direction, a third width region of the heat conductive member 60 on which the third width sheet passes through the nip. The third side members 623 are disposed outside the second side members 622 in the Y direction. For example, a length YD of, in the Y direction, a portion including the center member 61, the two first side members 621, the two second side members 622, and the two third side members 623 is a width (257 mm) of a B4 size.

The fourth side members 624 overlap, when viewed from the Z direction, a fourth width region of the heat conductive member 60 on which the fourth width sheet passes through the nip. The fourth side members 624 are disposed outside the third side members 623 in the Y direction. For example, a length YE of, in the Y direction, a portion including the center member 61, the two first side members 621, the two second side members 622, the two third side members 623, and the two fourth side members 624 is a width (297 mm) of an A3 size.

The heat conductive member 60 is divided in the Y direction for each heating region where the heater 37 heats the tubular body 36. The heater 37 has a central heating region HA and end heating regions HB. The central heating region HA includes a central portion of the heater 37 in the Y direction. The central heating region HA is continuous in the Y direction. The central heating region HA is a region to be heated by the central heating element 513. The end heating regions HB include ends of the heater 37 in the Y direction. The end heating regions HB are provided on a +Y side and a −Y side of the central heating region HA. The end heating regions HB are regions to be heated by the end heating elements 514 and 515.

The center member 61 in the heat conductive member 60 overlaps the central heating region HA when viewed from the Z direction. A length of the central heating region HA in the Y direction is substantially the same as the length YA of the center member 61 in the Y direction. The side members 62 in the heat conductive member 60 overlap the end heating regions HB when viewed from the Z direction. Lengths of the end heating regions HB in the Y direction are substantially the same as lengths of the side members 62 in the Y direction. The lengths of the end heating regions HB in the Y direction correspond to lengths between outer ends of the center member 61 in the Y direction and outer ends of the side members 62 (fourth side members 624) in the Y direction.

When the sheet passes through the fixing device 30, the heater 37 heats the tubular body 36, and raises the temperature to a target fixing temperature. When small size papers (sheet) pass, the heater 37 heats a paper passing region DP and non-paper-passing regions DN, which are the entire region of the tubular body 36. A temperature of the paper passing region DP is lowered since heat is taken away by heat fixing to the small size papers. On the other hand, temperatures of the non-paper-passing regions DN may rise excessively since heat is not taken away by heat fixing. When overheating of the non-paper-passing regions DN continues, the temperature reaches, for example, 260° C. When the temperature of the non-paper-passing regions DN is higher than a temperature threshold value (for example, 260° C.), the heater 37 may be damaged due to disconnection of a resistance wire of a heated portion. In order to prevent the damage, the temperature is detected by a thermistor provided in advance, and the paper is temporarily stopped or a standby operation is applied. The standby operation is continued until the temperature of the heater 37 with respect to the non-paper-passing regions DN drops to a preset temperature (for example, 120° C.)

Figure 9:
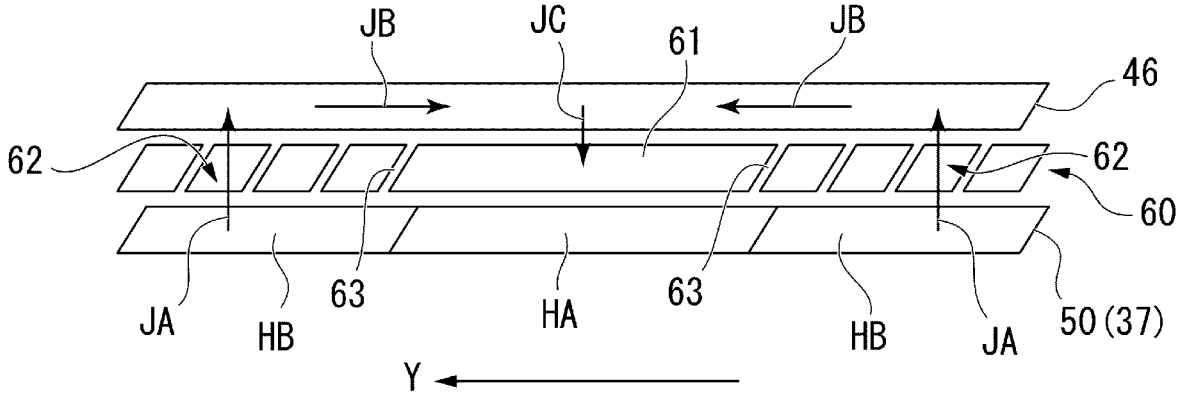
FIG. 9 is a view illustrating an operation of the heat conductive member.

FIG. 9 is a view illustrating an operation of the heat conductive member 60. FIG. 9 illustrates a perspective view of the substrate 50 of the heater 37 below a perspective view of the heat conductive member 60 on the paper. FIG. 9 illustrates a perspective view of the heat equalizing member 46 above the perspective view of the heat conductive member 60 on the paper.

When small size papers continuously pass, a temperature of a portion of the heater 37 facing a non-paper-passing region may rise excessively. FIG. 9 illustrates an example in which the end heating regions HB of the heater 37 face the non-paper-passing region. In the present embodiment, the heat conductive member 60 is divided into the center member 61 and the side members 62 in the Y direction. Accordingly, heat of the end heating regions HB of the heater 37, in which the temperature rises excessively, is transferred to the heat equalizing member 46 through the side members 62 of the heat conductive member 60. At this time, since the heat conductive member 60 is divided in the Y direction, the heat is not transferred=in the Y direction through the gaps 63. The heat of the end heating regions HB of the heater 37, in which the temperature rises excessively, is transferred in directions of arrows JA along the Z direction.

The heat equalizing member 46 has a thermal conductivity higher than that of the heat conductive member 60. Therefore, the heat transferred to end portion sides of the heat equalizing member 46 in the Y direction through the side members 62 is instantly transferred to a central portion side of the heat equalizing member 46 in the Y direction. The heat of the end sides of the heat equalizing member 46 in the Y direction is transferred in directions of arrows JB toward the central portion side of the heat equalizing member 46 in the Y direction. The heat transferred to the central portion side of the heat equalizing member 46 in the Y direction is transferred to the center member 61 of the heat conductive member 60 having a lower temperature. The heat of the central portion side of the heat equalizing member 46 in the Y direction is transferred toward the center member 61 of the heat conductive member 60 in a direction of an arrow JC. In this way, in the fixing device, since a temperature difference occurs in the Y direction of the nip, the heat is transferred in the order of the directions of the arrows JA, the directions of the arrows JB, and the direction of the arrow JC from a higher temperature side to a lower temperature side. The heat from the heater 37 is conducted to the heat conductive member 60 to raise the temperature and to achieve the same temperature as the heat equalizing member 46.

For example, if the heat conductive member 60 is not divided in the Y direction, the heat is dissipated into heat to be transferred to the heat equalizing member 46 and heat to be transferred to the heat conductive member 60. The heat to be transferred to the heat conductive member 60 is transferred in a plane of the heat conductive member 60 (particularly in the Y direction). Regarding heat conduction to a center side in the Y direction, that is, from the non-paper-passing regions DN to the paper passing region DP, the heat equalizing member 46 is better than the heat conductive member 60. Therefore, if the heat conductive member 60 is not divided in the Y direction, it is necessary to conduct more heat to the heat equalizing member 46. In contrast, in the present embodiment, since the heat conductive member 60 is divided in the Y direction, the heat of the non-paper-passing regions DN can be more effectively supplied to the heat equalizing member 46.

As described above, the fixing device 30 according to the present embodiment includes the tubular body 36, the heater 37, the heat equalizing member 46, and the heat conductive member 60. The tubular body 36 forms the nip N with the pressurizing member 31. The tubular body 36 is formed in a tubular shape. The tubular body 36 fixes, at the nip N, a recording material T on the sheet S. The heater 37 is disposed inside the tubular body 36. The heater 37 faces a part of the tubular body 36 in the circumferential direction. The heater 37 heats the tubular body 36. The heat equalizing member 46 is disposed on an opposite side of the side where the heater 37 faces the tubular body 36. The heat equalizing member 46 transfers the heat from the place having a high temperature to the place having a low temperature in the Y direction along the axial direction of the tubular body 36. The heat conductive member 60 is disposed between the heater 37 and the heat equalizing member 46. The heat conductive member 60 can conduct the heat in each of the Z direction and the Y direction in which the heater 37 and the heat equalizing member 46 face each other. The side portion of the heat conductive member 60 in the Y direction is divided into three or more portions.

According to the fixing device 30 of the present embodiment, when the temperature of the heater 37 rises locally and excessively in the Y direction, the heat of the heater 37 is transferred to the heat conductive member 60 facing the heater 37 in the Z direction. The heat transferred to the heat conductive member 60 is transferred to the heat equalizing member 46 facing the heat conductive member 60 in the Z direction. The heat is transferred from the higher temperature side to the lower temperature side. Therefore, the heat transferred to the heat equalizing member 46 is transferred to, through the heat conductive member 60, a portion of the heater 37 in the Y direction where the temperature is relatively low. Accordingly, it is possible to prevent a local temperature drop of the tubular body 36 in the Y direction. Therefore, an occurrence of a fixing failure can be prevented.

Moreover, since the heat conductive member 60 is divided in the Y direction, it is possible to prevent the heat conductive member 60 itself from rising flush.

In the present embodiment, the heat conductive member 60 is divided into the center member 61 and the side members 62 in the Y direction. Therefore, when the temperatures of the end sides of the heater 37 in the Y direction rise excessively during the continuous passing of the small size papers, the heat is transferred to the side members 62. The heat transferred to the side members 62 is transferred to the end sides of the heat equalizing member 46 in the Y direction, and is instantly transferred to the central portion side of the heat equalizing member 46. The heat transferred to the central portion side of the heat equalizing member 46 in the Y direction is transferred to, through the center member 61, the central portion side of the heater 37 in the Y direction. Accordingly, it is possible to prevent the temperature drop of the central portion of the tubular body 36 in the Y direction. Moreover, it is possible to prevent an excessive temperature rise of end sides (non-paper-passing regions DN) of the tubular body 36 in the Y direction.

Moreover, it is possible to prevent an excessive temperature rise of the end heating regions HB of the heater 37 facing the non-paper-passing regions DN. Therefore, the productivity can be increased without interrupting the printing operation.

Moreover, the heat transferred from the non-paper-passing regions DN of the heat equalizing member 46 is stored, whereby the heat can be kept after the paper passing is completed. Accordingly, it is possible to obtain a structure that the paper passing region DP whose temperature drops can be continuously heated. Therefore, the fixing device 30 can have a structure capable of efficiently supplying heat. Therefore, it is possible to prevent the excessive temperature rise of the non-paper-passing regions DN in the Y direction. By transferring the heat of the non-paper-passing regions DN to the paper passing region DP, an energy saving effect can be achieved.

The heater 37 includes the substrate 50 whose longitudinal direction is the Y direction. The thermal conductivity of the heat conductive member 60 is higher than that of the substrate 50. The thermal conductivity of the heat equalizing member 46 is higher than that of the heat conductive member 60, whereby the following effects are achieved.

Since the thermal conductivity of the heat conductive member 60 is higher than that of the substrate 50, when the temperature of the substrate 50 rises excessively during the continuous paper passing, heat of the substrate 50 can be more effectively transferred to the heat conductive member 60. Moreover, since the thermal conductivity of the heat equalizing member 46 is higher than that of the heat conductive member 60, heat of the heat conductive member 60 can be more effectively transferred to the heat equalizing member 46. Accordingly, it is possible to more effectively prevent the local temperature rise and temperature drop of the tubular body 36 in the Y direction.

The heat conductive member 60 is compressively deformable when the sheet S passes through the nip N, whereby the following effects are achieved.

When the sheet S passes through the nip N, the heat conductive member 60 is compressively deformed, whereby it is possible to improve the adhesion between the heater 37 and the heat conductive member 60 and the adhesion between the heat conductive member 60 and the heat equalizing member 46. Therefore, heat conduction performance can be improved.

The heat conductive member 60 is divided in the Y direction for each passing region on which the sheet S passes through the nip N, whereby the following effects are achieved.

Heat transfer paths in the heat conductive member 60 can be changed for each sheet S passing through the passing regions. Accordingly, the heat can be efficiently transferred according to a size of the sheet S. Therefore, it is possible to more effectively prevent the local temperature rise and temperature drop of the tubular body 36 in the Y direction according to the size of the sheet S.

The heat conductive member 60 is divided in the Y direction for each heating region where the heater 37 heats the tubular body 36, whereby the following effects are achieved.

The heat transfer paths in the heat conductive member 60 can be changed for each heating region of the heater 37. Accordingly, the heat can be efficiently transferred according to temperatures of the heating regions of the heater 37. Therefore, it is possible to more effectively prevent the local temperature rise and temperature drop of the tubular body 36 in the Y direction according to the temperatures of the heating regions of the heater 37.

The adjacent portions obtained by dividing the heat conductive member 60 in the Y direction are separated from each other, whereby the following effects are achieved.

The heat conduction of the adjacent portions obtained by dividing the heat conductive member 60 in the Y direction is prevented by the gaps 63. Therefore, it is possible to prevent heat equalization of the heat conductive member 60 in the Y direction.

The portion of the heat conductive member 60 overlapping, when viewed from the Z direction, the minimum width region DS where the sheet S having the minimum width passes through the nip N is continuous in the Y direction, whereby the following effects are achieved.

The heat of the portion of the heat conductive member 60 overlapping the minimum width region DS in the Z direction can be equalized in the Y direction. Accordingly, it is possible to more effectively prevent the local temperature drop of the minimum width region DS. Therefore, it is possible to prevent the occurrence of the fixing failure during continuous paper passing of the minimum width sheet.

The heater 37 is disposed inside the portion where the tubular body 36 faces the pressurizing member 31 so as to face the nip N, whereby the following effects are achieved.

Since the heat of the heater 37 can be directly transferred to the nip N, the heat fixing can be performed more effectively.

The heat equalizing member 46 is a heat pipe, whereby the following effects are achieved.

Since the heat pipe has a thermal conductivity higher than that of a metal plate such as a copper plate, when the temperature of the heater 37 rises locally and excessively in the Y direction during the continuous paper passing, the heat can be more effectively transferred in the Y direction. Accordingly, it is possible to more effectively prevent the local temperature rise and temperature drop of the tubular body 36 in the Y direction.

The heat conductive member 60 is a non-electrically conductive elastic member, whereby the following effects are achieved.

It is possible to absorb thermal expansion due to the heating of the heat equalizing member 46, the warpage of the heater 37, and the like by elastic deformation of the non-electrically conductive elastic member. Therefore, it is not necessary to improve the surface accuracy of the heat equalizing member 46 and the straightness accuracy of the support member 38 that supports the heat equalizing member 46.

Moreover, since the non-electrically conductive elastic member is disposed between the heater 37 and the heat equalizing member 46, the energization from the heater 37 is not conducted to the heat equalizing member 46. Therefore, it is possible to avoid the problem such as a short circuit.

When a material of the heat conductive member 60 is graphite, the following effects are achieved.

Since graphite has a thermal conductivity higher than that of a metal, when the temperature of the heater 37 rises locally and excessively in the Y direction during the continuous paper passing, the heat can be more effectively transferred to heat equalizing member 46 in the Y direction and the like. Accordingly, it is possible to more effectively prevent the local temperature rise and temperature drop of the tubular body 36 in the Y direction.

The fixing device 30 includes the substrate 50 disposed on a heat generating member 51 side opposite to the heated region 361. The heat conductive member 60 is disposed on a substrate 50 side opposite to the heat generating member 51, whereby the following effects are achieved.

The heat supplied from the heat generating member 51 is transferred to the tubular body 36 without passing through the substrate 50, and the heat supplied from the heat generating member 51 is transferred to the heat conductive member 60 via the substrate 50. Therefore, it is possible to promote the transfer of the heat to the tubular body 36 facing the heat generating member 51. Therefore, it is possible to more effectively prevent the temperature drop of the tubular body 36 in the Y direction.

Next, a second embodiment will be described with reference to FIG. 10. In the second embodiment, the description of the same configuration as that of the first embodiment will be omitted.

As illustrated in FIG. 3, the heat equalizing member 46 according to the first embodiment has a flat plate shape. In contrast, as illustrated in FIG. 10, a heat equalizing member 2046 according to the second embodiment is different from that in the first embodiment in that the heat equalizing member 2046 has a recess 2461 on an outer surface facing the heat conductive member 60 side.

Figure 10:
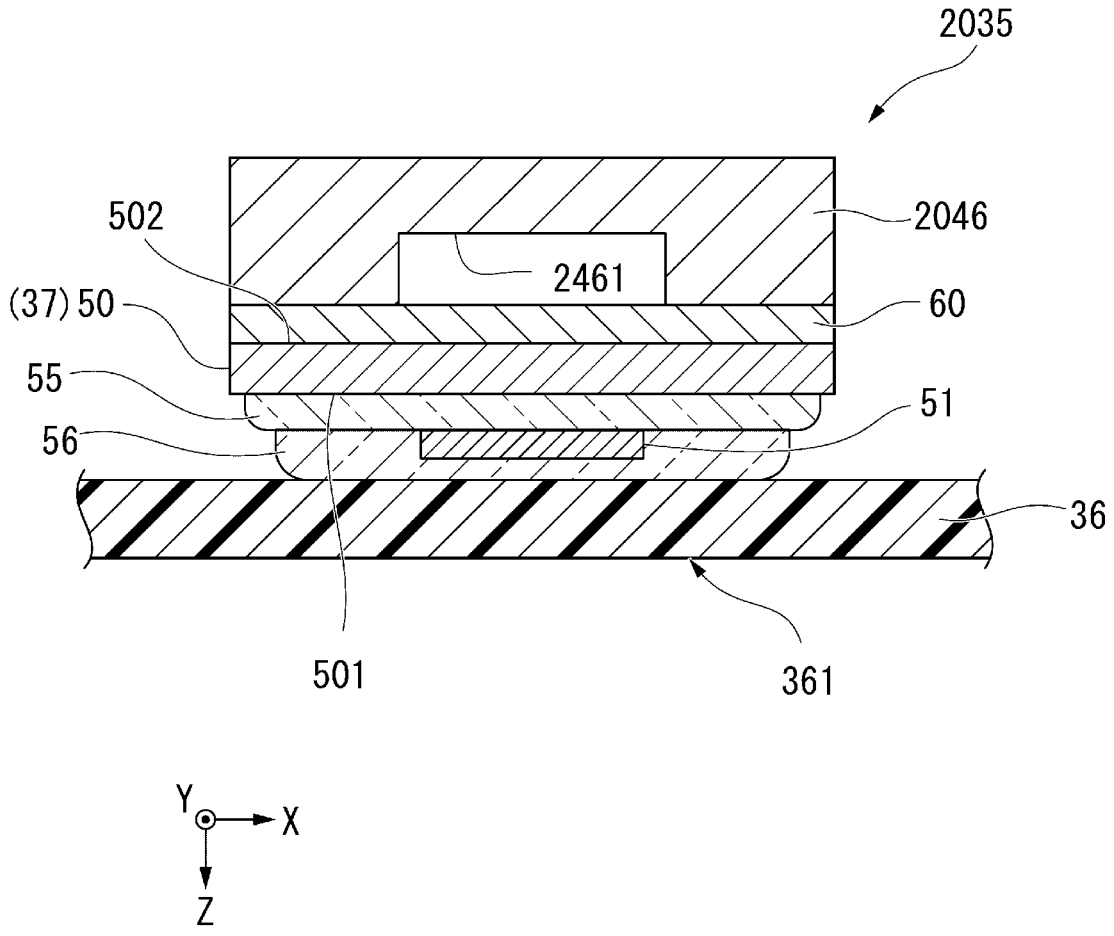
FIG. 10 illustrates an XZ cross-sectional view of a heating mechanism according to a second embodiment.

FIG. 10 illustrates an XZ cross-sectional view of a heating mechanism 2035 according to the second embodiment. FIG. 9 illustrates a view corresponding to an enlarged view of main parts in FIG. 3.

As illustrated in FIG. 10, the heat equalizing member 2046 has the recess 2461 on the outer surface facing the heat conductive member 60 side. The recess 2461 is formed so as to include a range in which the substrate 50 of the heater 37 is disposed in the Y direction. The recess 2461 penetrates the heat equalizing member 2046 in the Y direction. The recess 2461 is not in contact with the heat conductive member 60. On the other hand, both sides of the heat equalizing member 2046 in the X direction with respect to the recess 2461 are in contact with the heat conductive member 60.

When printing is started in the image forming apparatus 1, the heat generating member 51 heats the tubular body 36 to a fixing temperature. When the heat generating member 51 generates heat from room temperature, for example, a temperature distribution of the heat generating member 51 is highest at a center of the heat generating member 51 in the X direction. The temperature distribution of the heat generating member 51 decreases as a distance from the center of the heat generating member 51 increases in the X direction. Thus, the temperature distribution of the heat generating member 51 has a mountain shape having a temperature peak position. The recess 2461 of the heat equalizing member 2046 is formed so as to cover the center of the heat generating member 51 in the X direction, which is the temperature peak position.

According to the second embodiment, the heat equalizing member 2046 has the recess 2461 on the outer surface facing the heat conductive member 60 side, whereby the following effects are achieved.

Since the recess 2461 is not in contact with the heat conductive member 60, most of the heat generated by the heat generating member 51 is transferred to the tubular body 36 without being transferred to the heat equalizing member 2046. Since the tubular body 36 is efficiently heated, a time until the start of printing can be shortened. It is possible to prevent a restoration time of the image forming apparatus 1 from becoming long.

According to the second embodiment, the recess 2461 penetrates the heat equalizing member 2046 in the Y direction, whereby the following effects are achieved.

The heat generated by the heat generating member 51 is transferred to the tubular body 36 without being transferred to the heat equalizing member 2046 at any position in the Y direction. Since the tubular body 36 is heated more efficiently, the time until the start of printing can be further shortened.

Next, a modification of the embodiment will be described.

The wiring set (contact and wiring) provided on the substrate of the heater is not limited to being disposed on a tubular body side. For example, the wiring set may be disposed on an opposite side of the tubular body. Accordingly, it is possible to avoid the contact and the wiring from being worn down due to friction with the tubular body.

The heat conductive member is not limited to being divided into nine members that are separated from each other with a gap in the Y direction. For example, the heat conductive member may be divided into 8 or less or 10 or more members that are separated from each other with a gap in the Y direction. For example, the side portion of the heat conductive member in the Y direction may be divided into three or more portions. For example, a division mode of the heat conductive member can be changed according to a required specification.

The thermal conductivity of the heat conductive member is not necessarily higher than the thermal conductivity of the substrate. For example, the thermal conductivity of the heat conductive member may be equal to or lower than the thermal conductivity of the substrate. For example, the thermal conductivity of the heat conductive member can be changed according to a required specification.

The thermal conductivity of the heat equalizing member is not necessarily higher than the thermal conductivity of the heat conductive member. For example, the thermal conductivity of the heat equalizing member may be equal to or lower than the thermal conductivity of the heat conductive member. For example, the thermal conductivity of the heat equalizing member can be changed according to a required specification.

The heat conductive member is not limited to being compressively deformable when the sheet passes through the nip. For example, the heat conductive member may not be compressively deformable when the sheet passes through the nip. For example, a mode of the heat conductive member can be changed according to a required specification.

The heat conductive member is not limited to being divided in the Y direction for each passing region where the sheet passes through the nip. For example, the heat conductive member may not be divided in the Y direction for the each passing region. For example, the heat conductive member may be divided in the Y direction for each region different from the passing regions. For example, the division mode of the heat conductive member can be changed according to a required specification.

The heat conductive member is not limited to being divided in the Y direction for each heating region where the heater heats the tubular body. For example, the heat conductive member may not be divided in the Y direction for each heating region. For example, the heat conductive member may be divided in the Y direction for each region different from the heating regions. For example, the division mode of the heat conductive member can be changed according to a required specification.

Adjacent portions obtained by dividing the heat conductive member in the Y direction are not limited to being separated from each other. For example, the adjacent portions obtained by dividing the heat conductive member in the Y direction may be in contact with each other. For example, an adjacent mode of the adjacent portions obtained by dividing the heat conductive member in the Y direction can be changed according to a required specification.

The portion of the heat conductive member overlapping, when viewed from the Z direction, the minimum width region where the sheet having the minimum width passes through the nip is not limited to being continuous in the Y direction. For example, the portion of the heat conductive member overlapping, when viewed from the Z direction, the minimum width region where the sheet having the minimum width passes through the nip may not be continuous in the Y direction. For example, a mode of the portion of the heat conductive member overlapping, when viewed from the Z direction, the minimum width region where the sheet having the minimum width passes through the nip can be changed according to a required specification.

The heater is not limited to being disposed inside a portion where the tubular body faces the pressurizing member so as to face the nip. For example, the heater may not face the nip. For example, the heater may face the heated region, which is a part of the tubular body in the circumferential direction. For example, a disposition mode of the heater can be changed according to a required specification.

The heat equalizing member is not limited to a heat pipe. For example, the heat equalizing member may be a metal plate made of copper, aluminum, or the like, or a metal thin film. For example, a mode of the heat equalizing member can be changed according to a required specification.

The heat conductive member is not limited to a non-electrically conductive elastic member. For example, the heat conductive member may be an electrically conductive member made of a metal or the like. For example, a mode of the heat conductive member can be changed according to a required specification.

The material of the heat conductive member is not limited to graphite. For example, the material of the heat conductive member may be a metal such as copper or aluminum. For example, the material of the heat conductive member can be changed according to a required specification.

The pressurizing member is not limited to a pressure roller. For example, the pressurizing member may not be a pressure roller. For example, the pressurizing member may not have a cylindrical shape. For example, the pressurizing member may have a rectangular parallelepiped shape. For example, the pressurizing member may have a shape that forms the nip together with the tubular body. For example, a mode of the pressurizing member can be changed according to a required specification.

The fixing device is not limited to including the substrate disposed on the heat generating member side opposite to the heated region. For example, the fixing device may include the substrate disposed on the heat generating member side same as the heated region. For example, the heat generating member may be disposed on the substrate side opposite to the heated region on. For example, the disposition mode of the heat generating member and the substrate can be changed according to a required specification.

The heat conductive member is not limited to being disposed on the substrate side opposite to the heat generating member. For example, the heat conductive member may be disposed on the substrate side same as the heat generating member. For example, a disposition mode of the heat conductive member can be changed according to a required specification.

The fixing device is not limited to including the support member that is disposed on the heat conductive member side opposite to the heater and that supports the heater via the heat conductive member. For example, the fixing device may not include the support member. For example, a stay may be configured to support the heater via the heat conductive member. For example, an installation mode of the support member can be changed according to a required specification.

The heat conductive member is not limited to being fixed at a fixed position by being sandwiched by a predetermined force. For example, the heat conductive member may be fixed at the fixed position with a double-sided tape or an adhesive. For example, the heat conductive member may be fixed at the fixed position by surface tension due to a liquid such as silicone oil. For example, a fixing mode of the heat conductive member can be changed according to a required specification.

According to at least one embodiment described above, the fixing device 30 includes the tubular body 36, the heater 37, the heat equalizing member 46, and the heat conductive member 60. The tubular body 36 forms the nip N with the pressurizing member 31. The tubular body 36 is formed in a tubular shape. The tubular body 36 fixes, at the nip N, the recording material T on the sheet S. The heater 37 is disposed inside the tubular body 36. The heater 37 faces a part of the tubular body 36 in the circumferential direction. The heater 37 heats the tubular body 36. The heat equalizing member 46 is disposed on an opposite side of the side where the heater 37 faces the tubular body 36. The heat equalizing member 46 transfers the heat from the place having a high temperature to the place having a low temperature in the Y direction along the axial direction of the tubular body 36. The heat conductive member 60 is disposed between the heater 37 and the heat equalizing member 46. The heat conductive member 60 can conduct the heat in each of the Z direction and the Y direction in which the heater 37 and the heat equalizing member 46 face each other. The side portion of the heat conductive member 60 in the Y direction is divided into three or more portions.

According to the fixing device 30 of the present embodiment, when the temperature of the heater 37 rises locally and excessively in the Y direction, the heat of the heater 37 is transferred to the heat conductive member 60 facing the heater 37 in the Z direction. The heat transferred to the heat conductive member 60 is transferred to the heat equalizing member 46 facing the heat conductive member 60 in the Z direction. The heat is transferred from the higher temperature side to the lower temperature side. Therefore, the heat transferred to the heat equalizing member 46 is transferred to, through the heat conductive member 60, the portion of the heater 37 in the Y direction where the temperature is relatively low. Accordingly, it is possible to prevent the local temperature drop of the tubular body 36 in the Y direction. Therefore, the occurrence of the fixing failure can be reduced.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A fixing device, comprising:

a tubular body having a tubular shape, and configured to form a nip with a pressurizing member and fix, at the nip, a recording material on a recording medium;

a heater disposed inside the tubular body, facing a part of the tubular body in a circumferential direction, and configured to heat the tubular body;

a heat equalizing member disposed on an opposite side of the tubular body where the heater faces the tubular body, and configured to transfer heat from a place having a high temperature to a place having a low temperature in a second direction along an axial direction of the tubular body; and a heat conductive member disposed between the heater and the heat equalizing member, and configured to conduct the heat in each of the second direction and a first direction in which the heater and the heat equalizing member face each other, a side portion thereof in the second direction being divided into three or more portions.

2. The fixing device according to claim 1, wherein the heater comprises a substrate having a longitudinal direction in the second direction, a thermal conductivity of the heat conductive member is higher than a thermal conductivity of the substrate, and a thermal conductivity of the heat equalizing member is higher than the thermal conductivity of the heat conductive member.

3. The fixing device according to claim 1, wherein the heat conductive member is compressively deformable when the recording medium passes through the nip.

4. The fixing device according to claim 1, wherein the heat conductive member is divided in the second direction for each passing region where the recording medium passes through the nip.

5. The fixing device according to claim 1, wherein the heat conductive member is divided in the second direction for each heating region where the heater heats the tubular body.

6. The fixing device according to claim 1, wherein adjacent portions obtained by dividing the heat conductive member in the second direction are separated from each other.

7. The fixing device according to claim 1, wherein a portion of the heat conductive member overlapping, when viewed from the first direction, a minimum width region where the recording medium having a minimum width passes through the nip is continuous in the second direction.

8. The fixing device according to claim 1, wherein the heater is disposed inside a portion where the tubular body faces the pressurizing member so as to face the nip.

9. The fixing device according to claim 1, wherein the heat equalizing member is a heat pipe.

10. The fixing device according to claim 1, wherein the heat conductive member is a non-electrically conductive elastic member.

11. A fixing method, comprising:

forming a nip with a tubular body having a tubular shape and a pressurizing member and fixing, at the nip, a recording material on a recording medium;

heating the tubular body with a heater disposed inside the tubular body, facing a part of the tubular body in a circumferential direction;

transferring heat from a place having a high temperature to a place having a low temperature in a second direction along an axial direction of the tubular body with a heat equalizing member disposed on an opposite side of the tubular body where the heater faces the tubular body; and conducting the heat in each of the second direction and a first direction in which the heater and the heat equalizing member face each other, a side portion thereof in the second direction being divided into three or more portions with a heat conductive member disposed between the heater and the heat equalizing member.

12. The method according to claim 11, wherein the heater comprises a substrate having a longitudinal direction in the second direction, a thermal conductivity of the heat conductive member is higher than a thermal conductivity of the substrate, and a thermal conductivity of the heat equalizing member is higher than the thermal conductivity of the heat conductive member.

13. The method according to claim 11, further comprising:

compressively deforming the heat conductive member when the recording medium passes through the nip.

14. An image forming apparatus, comprising:

a scanner;

a sheet supply component;

a transport component;

a paper discharge tray; and a fixing device, comprising:

a tubular body having a tubular shape, and configured to form a nip with a pressurizing member and fix, at the nip, a recording material on a recording medium;

a heater disposed inside the tubular body, facing a part of the tubular body in a circumferential direction, and configured to heat the tubular body;

a heat equalizing member disposed on an opposite side of the tubular body where the heater faces the tubular body, and configured to transfer heat from a place having a high temperature to a place having a low temperature in a second direction along an axial direction of the tubular body; and a heat conductive member disposed between the heater and the heat equalizing member, and configured to conduct the heat in each of the second direction and a first direction in which the heater and the heat equalizing member face each other, a side portion thereof in the second direction being divided into three or more portions.

15. The image forming apparatus according to claim 14, wherein the heater comprises a substrate having a longitudinal direction in the second direction, a thermal conductivity of the heat conductive member is higher than a thermal conductivity of the substrate, and a thermal conductivity of the heat equalizing member is higher than the thermal conductivity of the heat conductive member.

16. The image forming apparatus according to claim 14, wherein the heat conductive member is divided in the second direction for each passing region where the recording medium passes through the nip.

17. The image forming apparatus according to claim 14, wherein the heat conductive member is divided in the second direction for each heating region where the heater heats the tubular body.

18. The image forming apparatus according to claim 14, wherein adjacent portions obtained by dividing the heat conductive member in the second direction are separated from each other.

19. The image forming apparatus according to claim 14, wherein a portion of the heat conductive member overlapping, when viewed from the first direction, a minimum width region where the recording medium having a minimum width passes through the nip is continuous in the second direction.

20. The image forming apparatus according to claim 14, wherein the heater is disposed inside a portion where the tubular body faces the pressurizing member so as to face the nip.

* * * * *